US009372452B2

(12) United States Patent
Kamiya et al.

(10) Patent No.: US 9,372,452 B2
(45) Date of Patent: Jun. 21, 2016

(54) FIXING DEVICE AND IMAGE FORMING APPARATUS

(71) Applicant: FUJI XEROX Co., Ltd., Tokyo (JP)

(72) Inventors: Shogo Kamiya, Kanagawa (JP); Norio Ogawahara, Kanagawa (JP); Keisuke Hidaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/613,555

(22) Filed: Feb. 4, 2015

(65) Prior Publication Data

US 2016/0077476 A1 Mar. 17, 2016

(30) Foreign Application Priority Data

Sep. 17, 2014 (JP) ..... 2014-188691

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
USPC ..... 399/329
See application file for complete search history.

(56) References Cited

U.S. PATENT DOCUMENTS

| | | | | |
|---|---|---|---|---|
| 7,433,627 | B2 * | 10/2008 | German | G03G 15/2007 347/102 |
| 7,440,722 | B2 * | 10/2008 | Lofthus | G03G 15/2007 219/216 |
| 8,467,712 | B2 | 6/2013 | Kodera et al. | |
| 2015/0093170 | A1 * | 4/2015 | Kodera | G03G 15/2007 399/336 |
| 2016/0026122 | A1 * | 1/2016 | Matsubara | G03G 15/2007 399/336 |

FOREIGN PATENT DOCUMENTS

| | | | |
|---|---|---|---|
| JP | 2012-088372 | A | 5/2012 |
| JP | 2013-057855 | A | 3/2013 |

* cited by examiner

*Primary Examiner* — Walter L Lindsay, Jr.
*Assistant Examiner* — Ruth Labombard
(74) *Attorney, Agent, or Firm* — Sughrue Mion, PLLC

(57) ABSTRACT

A fixing device includes a light source that emits laser light; a condensing member including a lens having a first surface from which the laser light enters and a second surface from which the laser light emerges, the lens condensing the laser light that has entered from the first surface and emitting the laser light from the second surface; and a roller provided in contact with the condensing member and that transports a recording medium advanced into a position between the roller and the condensing member. A portion of the second surface is made of a material that blocks the laser light. In a section perpendicular to an axis of rotation of the roller, a plane of contact between the roller and the condensing member includes at least a part of the portion made of the material that blocks the laser light.

7 Claims, 10 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2014-188691 filed Sep. 17, 2014.

BACKGROUND (i) Technical Field

The present invention relates to a fixing device and an image forming apparatus.

(ii) Related Art

Regarding image forming apparatuses, there is a technique of fixing toner to a recording medium by applying laser light to the toner.

SUMMARY

According to an aspect of the invention, there is provided a fixing device including a light source that emits laser light; a condensing member including a lens having a first surface from which the laser light enters and a second surface from which the laser light emerges, the lens condensing the laser light that has entered from the first surface and emitting the laser light from the second surface; and a roller provided in contact with the condensing member and that transports a recording medium advanced into a position between the roller and the condensing member. A portion of the second surface is made of a material that blocks the laser light. In a section perpendicular to an axis of rotation of the roller, a plane of contact between the roller and the condensing member includes at least a part of the portion made of the material that blocks the laser light.

BRIEF DESCRIPTION OF THE DRAWINGS

Exemplary embodiments of the present invention will be described in detail based on the following figures, wherein.

DETAILED DESCRIPTION

1. First Exemplary Embodiment 1-1. Overall Configuration

Figure 1:
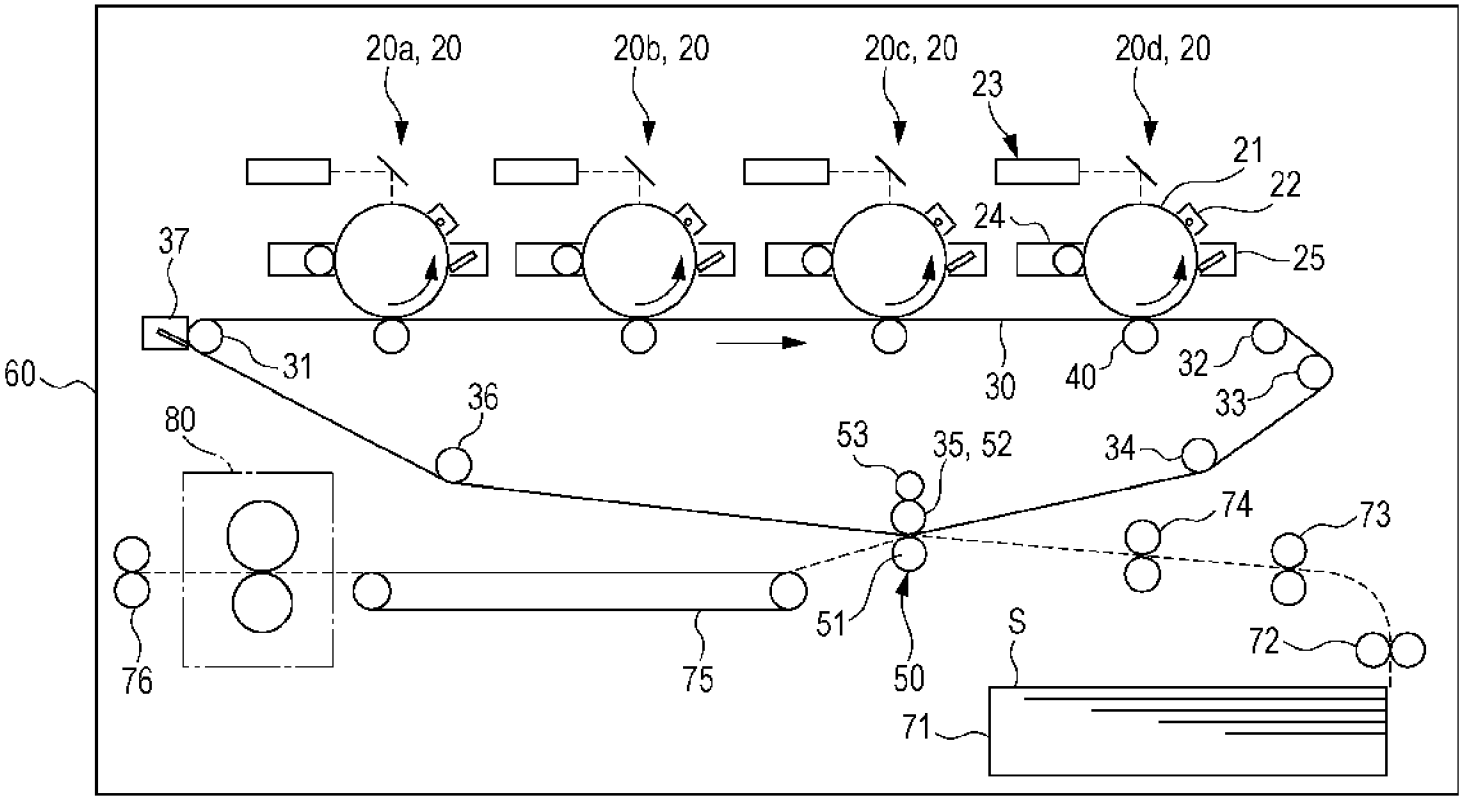
FIG. 1 illustrates an overall configuration of an image forming apparatus according to a first exemplary embodiment.

FIG. 1 illustrates an overall configuration of an image forming apparatus according to a first exemplary embodiment. The image forming apparatus includes image forming units 20, an intermediate transfer body 30, a collective transfer device (second transfer device) 50, and a fixing device 80 that are all housed in an apparatus housing 60. The image forming units 20 (20*a* to 20*d*, specifically) form images (toner images) to be formed on a recording medium S in plural color components (yellow (Y), magenta (M), cyan (C), and black (K) in the first exemplary embodiment) by using image forming materials. Before the images formed in the respective color components by the respective image forming units 20 are transferred to the recording medium S, the intermediate transfer body 30, which is a belt member, temporarily carries and transports the images. The collective transfer device 50 collectively transfers the images in the respective color components on the intermediate transfer body 30 to the recording medium S. The fixing device 80 fixes, to the recording medium S, the images that have been transferred collectively to the recording medium S by the collective transfer device 50 but are yet to be fixed. At least one of the image forming units 20, the intermediate transfer body 30, and the collective transfer device 50 corresponds to an exemplary image forming device that forms a toner image on a recording medium S.

The image forming units 20 basically employs an electrophotographic system. The image forming units 20 each include a photoconductor 21, around which a charging device 22, a latent image forming device 23, a developing device 24, and a cleaning device 25 are arranged in that order. The photoconductor 21 is a drum member including a photosensitive layer on its surface and being rotatable in a predetermined direction. The charging device 22 is, for example, a corotron charger and charges the photoconductor 21 in advance. The latent image forming device 23 is, for example, a laser scanning device and forms, with light, an electrostatic latent image on the photoconductor 21 that has been charged by the charging device 22. The developing device 24 develops the electrostatic latent image formed by the latent image forming device 23 into a toner image in a corresponding one of the color components. The cleaning device 25 removes residual toner and so forth from the photoconductor 21.

The intermediate transfer body 30 is a belt member that is stretched around plural stretching rollers 31 to 36. The intermediate transfer body 30 is rotated in a predetermined direction with, for example, the stretching roller 31 functioning as a driving roller and the other stretching rollers 32 to 36 functioning as follower rollers. In the first exemplary embodiment, the stretching roller 33 functions as a tension applying roller that applies a predetermined tension to the intermediate transfer body 30. The stretching roller 35 also functions as a counter roller 52 included in the collective transfer device 50.

First transfer devices 40 are provided on the inner side of the intermediate transfer body 30 at positions across the intermediate transfer body 30 from the respective image forming units 20 (20*a* to 20*d*). In the first exemplary embodiment, the first transfer devices 40 each include, for example, a transfer roller to which a first transfer voltage is applied. Thus, a first-transfer electric field is produced between the transfer roller and the photoconductor 21, whereby the image on the photoconductor 21 is transferred to the intermediate transfer body 30 for the first transfer. An intermediate-transfer-body-cleaning device 37 removes residual toner and so forth from the intermediate transfer body 30.

The collective transfer device (second transfer device) 50 includes the counter roller 52, which also functions as the stretching roller 35 provided for the intermediate transfer body 30, a transfer roller 51 provided on the outer side of the intermediate transfer body 30 and facing the counter roller 52, and a feeder roller 53 provided in contact with the surface of the counter roller 52. In the collective transfer device 50 according to the first exemplary embodiment, a collective-transfer voltage (second-transfer voltage) is applied to the feeder roller 53 while the transfer roller 51 is grounded. Thus, a collective-transfer electric field (second-transfer electric field) is produced between the transfer roller 51 and the intermediate transfer body 30, whereby the images in the respective color components on the intermediate transfer body 30 are collectively transferred to the recording medium S. The recording medium S is one of plural recording media S stored in a storage device 71. The recording media S are fed from the storage device 71 one by one. Each recording medium S thus fed is transported to a pair of registration rollers 74 by plural pairs of transport rollers 72 and 73 and, after being registered by the pair of registration rollers 74, is transported to a collective transfer area defined in the collective transfer device 50. The recording medium S having passed through the collective transfer area is further transported to the fixing device 80 by a transport belt 75 and is ejected to an output tray (not illustrated) by a pair of ejecting rollers 76.

1-2. Configuration of Fixing Device

Figure 2:
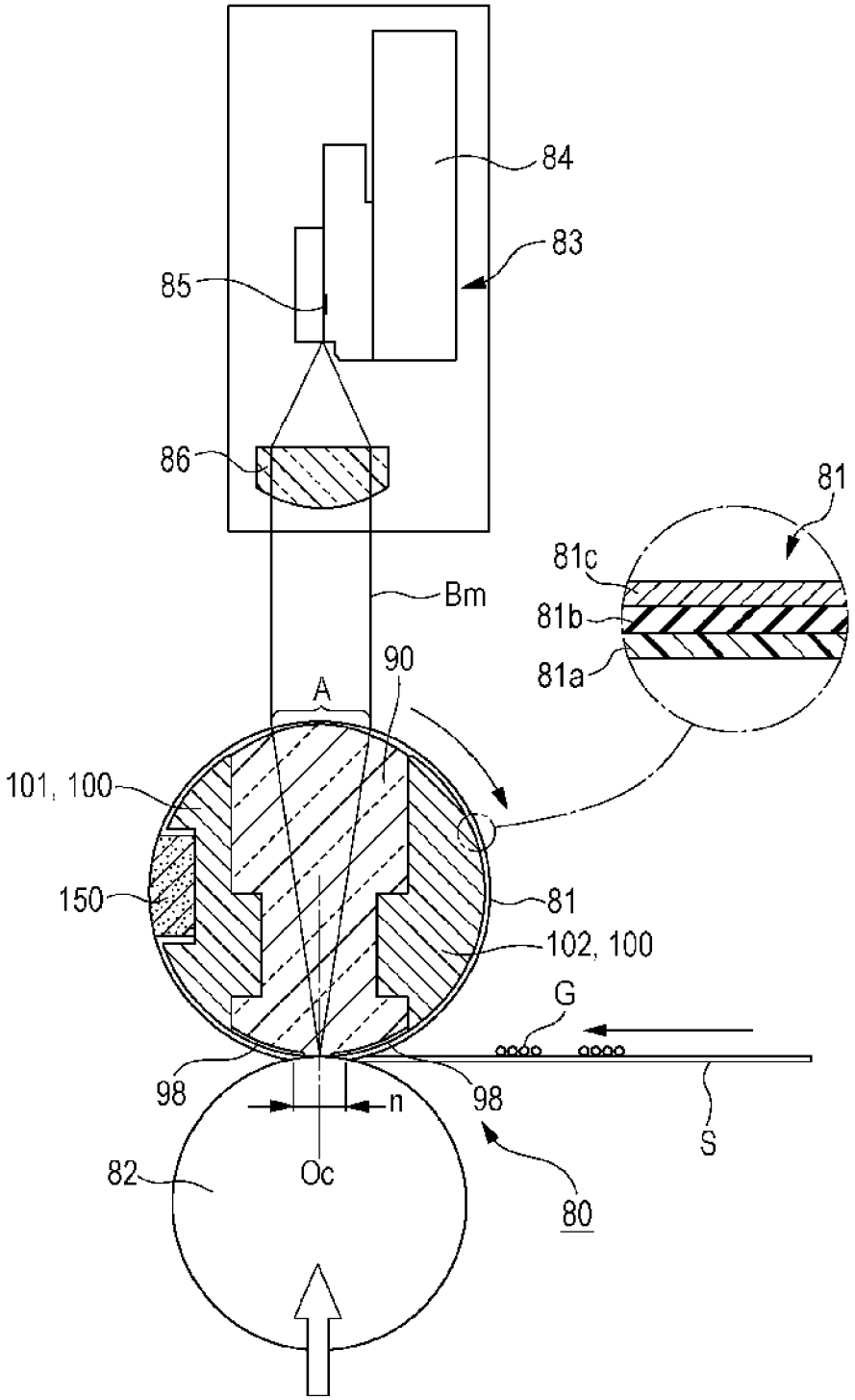
FIG. 2 is a sectional view illustrating an overall configuration of a fixing device according to the first exemplary embodiment and includes an enlarged sectional view of a transparent tube.

FIG. 2 is a sectional view illustrating an overall configuration of the fixing device 80 and includes an enlarged sectional view of a transparent tube 81. The fixing device 80 includes the transparent tube 81 (an exemplary tube body), a counter roller 82 (an exemplary roller), a laser-light-emitting device 83 (an exemplary light source), a lens pad 90 (an exemplary lens), and a holding frame 100. The transparent tube 81 is a tube body made of a material that transmits laser light Bm. The transparent tube 81 houses the holding frame 100 and the lens pad 90. The holding frame 100 and the lens pad 90 are not fixed to the transparent tube 81, and the transparent tube 81 is rotatable with respect to the holding frame 100 and the lens pad 90. The counter roller 82 is provided in contact with the lens pad 90 with the transparent tube 81 interposed therebetween and thus transports the recording medium S advancing into a position between the counter roller 82 and the lens pad 90. Herein, the position between the counter roller 82 and the lens pad 90 refers to a gap between the counter roller 82 and a portion of the transparent tube 81 that faces the lens pad 90. The counter roller 82 is provided opposite the transparent tube 81 such that a contact area n is provided between the counter roller 82 and the transparent tube 81. The transparent tube 81 rotates with the rotation of the counter roller 82 and thus transports the recording medium S.

The laser-light-emitting device 83 is provided outside the transparent tube 81 and emits the laser light Bm toward a predetermined light entering position A of the transparent tube 81. The lens pad 90 is provided inside the transparent tube 81 and presses the transparent tube 81 against the counter roller 82 in the contact area n. The lens pad 90 also functions as a pressing-and-condensing member that condenses the laser light Bm, emitted toward the light entering position A of the transparent tube 81 and falling onto an image G on the recording medium S, in a direction of transport of the recording medium S and within the contact area n.

1-2-1. Transparent Tube

The transparent tube 81 rotates with the rotation of the counter roller 82 and thus transports the recording medium S. In the first exemplary embodiment, the term "transparent" used in describing the transparent tube 81 means that the transmittance with respect to the wave range of the laser light Bm is higher than a predetermined threshold. In the first exemplary embodiment, the transparent tube 81 only needs to transmit the laser light Bm. In terms of light utilization efficiency and the prevention of heating of the lens pad 90, the transparent tube 81 may have as high transmittance as possible. For example, the transmittance may be 90% or higher, or preferably 95% or higher.

As illustrated in FIG. 2, the transparent tube 81 includes three layers, which are a base layer 81*a*, an elastic layer 81*b*, and a release layer 81*c*. The base layer 81*a* provides a satisfactory strength. The elastic layer 81*b* is provided over the base layer 81*a*. The release layer 81*c* is provided over the elastic layer 81*b* and is made of a material from which the toner, as an image forming material, is easily released. In the first exemplary embodiment, the transparent tube 81 is not limited to such a three-layer structure and may include any layers that realize the function thereof, of course.

The base layer 81*a* is made of a material selected from the group including the following substances and any mixtures thereof: silicones such as polyvinylidene difluoride (PVDF), polyimide (PI), polyethylene (PE), polyurethane (PU), and polydimethylsiloxane (PDMS); polyether ether ketone (PEEK); polyether sulfone (PES); fluorinated ethylene propylene (FEP); ethylene-tetrafluoroethylene copolymer (ETFE); chlorotrifluoroethylene (CTFE); polyvinylidene difluoride (PVDF); polyvinyl fluoride (PVF); and polytetrafluoroethylene (PTFE). The elastic layer 81*b* is made of liquid silicone rubber (LSR), high-temperature-vulcanizing (HTV) silicone rubber, room-temperature vulcanizing (RTV) silicone rubber, or the like. The elastic layer 81*b* transmits the laser light Bm and is elastic enough to absorb surface irregularities in the recording medium S and surface irregularities in the image G formed of toner (hereinafter also referred to as toner image G). The release layer 81*c* is made of fluoroplastic such as polytetrafluoroethylene (PTFE), perfluoro alkoxy fluoroplastic (PFA), or fluorinated ethylene-propylene copolymer (FEP). The release layer 81*c* only needs to transmit the laser light Bm and to facilitate the releasing of the toner image G on the recording medium S from the transparent tube 81. The release layer 81*c* also has a function of giving a gloss to the fixed image in cooperation with the elastic layer 81*b*.

1-2-2. Counter Roller

The counter roller 82 is made of, for example, aluminum, stainless steel, or a copper sheet plated with nickel or the like. The counter roller 82 is positioned such that a predetermined pressure is applied to the transparent tube 81.

1-2-3. Laser-Light-Emitting Device

The laser-light-emitting device 83 includes a laser array 84 and a collimator lens 86. The laser array 84 includes plural laser light sources 85 that are aligned in a direction perpendicular to the plane of the page in FIG. 2. The collimator lens 86 is an optical member that collimates beams of laser light Bm emitted from the respective laser light sources 85 included in the laser array 84. The collimator lens 86 is incorporated in a housing (not illustrated) of the laser-light-emitting device 83. In the laser-light-emitting device 83, the position to which the beams of laser light Bm emitted from the laser light sources 85 are applied and the intensity of the beams of laser light Bm are selectable. The laser light sources 85 each include, for example, a laser element such as a solid laser, a liquid laser, a gas laser, or a semiconductor laser, and emit the laser light Bm.

1-2-4. Lens Pad

The lens pad 90 condenses, within the contact area n, the laser light Bm emitted toward the light entering position A of the transparent tube 81 and falling onto the toner image G on the recording medium S. The material of the lens pad 90 is selected from those intended for normal lenses and having heat resistance. Examples of such a material include various kinds of glass for optical use, and transparent plastic resins for optical use. Exemplary transparent plastic resins for optical use include polydiethyleneglycol-bis-allylcarbonate (PEDC), polymethylmethacrylate (PMMA), polystyrene (PSt), a polymer composed of methylmethacrylate units and styrene units (methylmethacrylate-styrene (MS) copolymer), polycarbonate, cycloolefin resin, fluorine resin, and the like.

The lens pad 90 only needs to be designed to have a depth of focus that is most suitable for the distance from the point of entrance of the laser light Bm to the point of emergence of the laser light Bm. The lens pad 90 originally has a function of condensing light. In addition, the lens pad 90 is in contact with portions of the transparent tube 81 that correspond to the light entering position A and the contact area n, respectively, and has a function of applying pressure to the image G on the recording medium S in the contact area n. The pressure applied by the lens pad 90 is determined such that a predetermined level of fixability calculated from the heating energy exerted by the laser light Bm is obtained.

Figure 3:
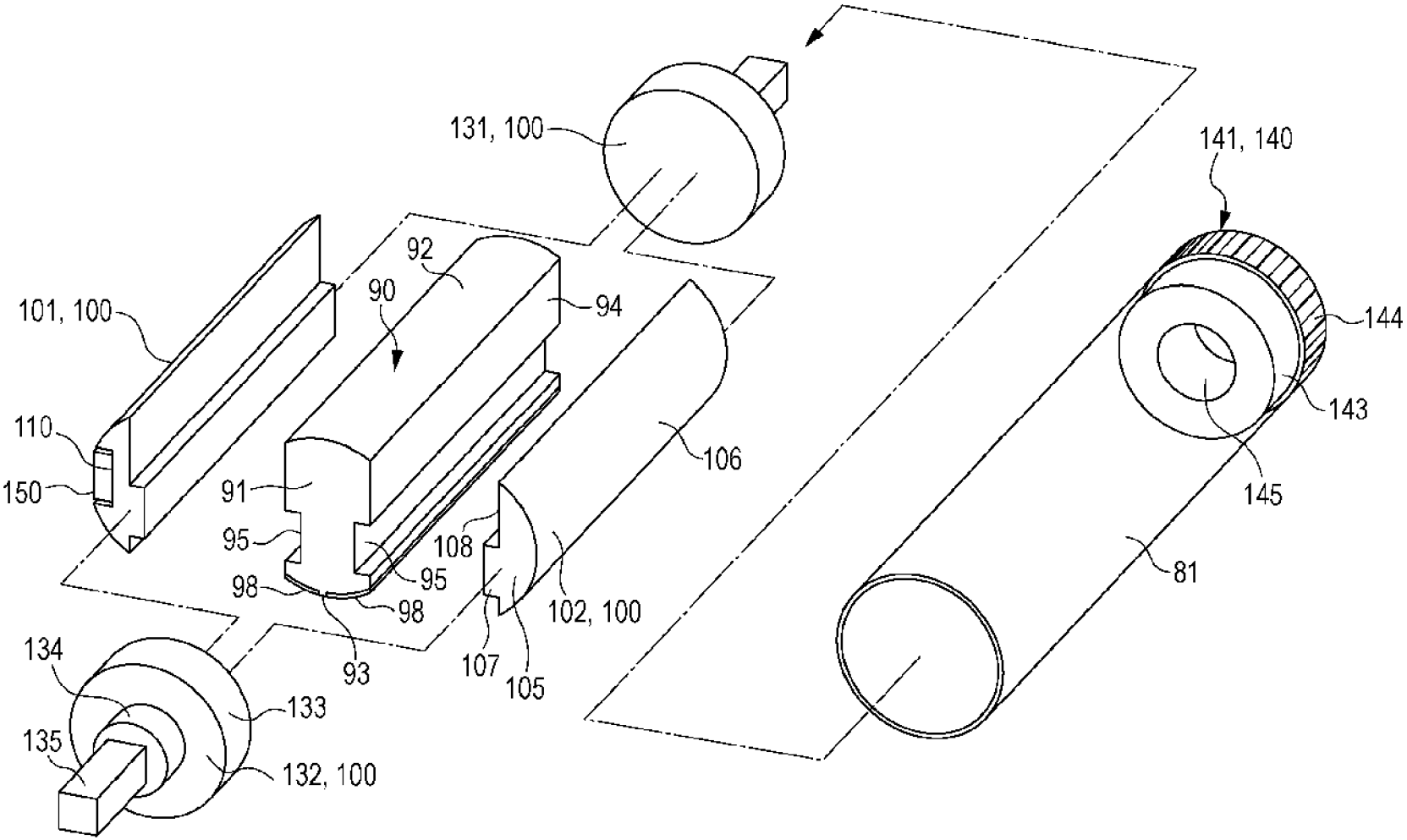
FIG. 3 is an exploded perspective view illustrating elements of an assembly included in the fixing device according to the first exemplary embodiment.
Figure 4:
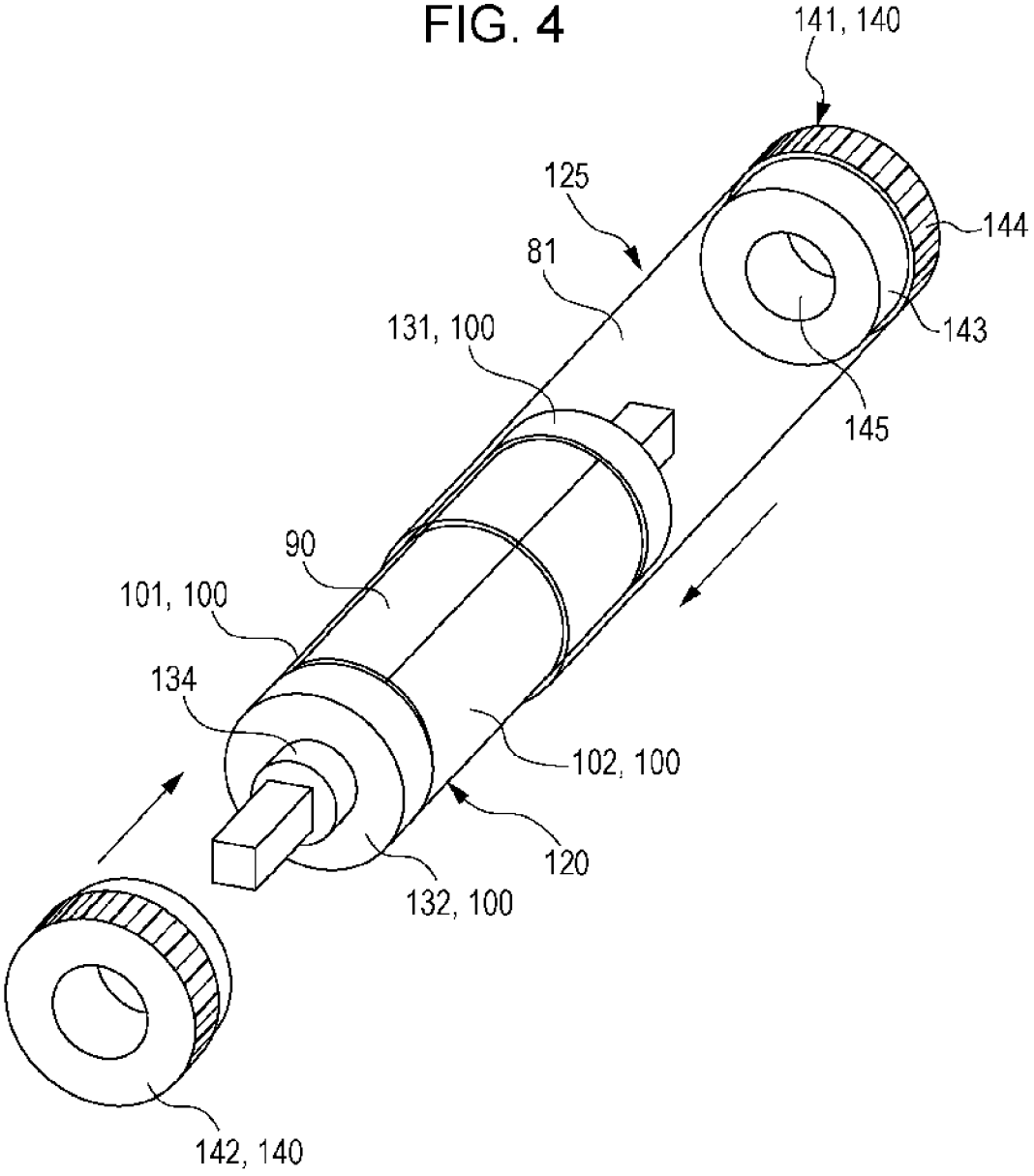
FIG. 4 illustrates how to assemble the elements of the assembly included in the fixing device according to the first exemplary embodiment.

FIG. 3 is an exploded perspective view illustrating elements of an assembly included in the fixing device 80. FIG. 4 illustrates how to assemble the elements of the assembly included in the fixing device 80. Referring to FIGS. 2 and 3, the lens pad 90 includes the lens body 91 that condenses, in a direction of transmission of the laser light Bm, the plural beams of laser light Bm emitted from the laser array 84. The lens body 91 is a long lens member extending in the longitudinal direction of the laser array 84. The lens body 91 has a light entering surface 92 and a light emerging surface 93. The light entering surface 92 is provided at a position corresponding to the light entering position A of the transparent tube 81 and is curved in the direction of rotation of the transparent tube 81. The light emerging surface 93 is provided at a position corresponding to the contact area n between the transparent tube 81 and the counter roller 82 and is curved in the direction of rotation of the transparent tube 81. The light entering surface 92 and the light emerging surface 93 are in contact with the inner surface of the transparent tube 81. The lens pad 90 includes flat portions 94 on two respective sides of the lens body 91 excluding the light entering surface 92 and the light emerging surface 93. The flat portions 94 are substantially parallel to each other. The flat portions 94 have respective positioning grooves 95 extending in the longitudinal direction of the laser array 84 and each having a substantially rectangular sectional shape. The flat portions 94 and the positioning grooves 95 are formed by integral molding.

The holding frame 100 includes side holding frames 101 and 102 and end holding frames 131 and 132. The side holding frames 101 and 102 are a pair of holding frames that hold the lens pad 90 from two respective sides. The end holding frames 131 and 132 are fixedly bonded to two respective longitudinal ends of a subassembly including the lens pad 90 and the pair of side holding frames 101 and 102 with adhesive (not illustrated). The side holding frames 101 and 102 each include a long, integrally molded frame member 105 made of, for example, metal such as aluminum or stainless steel, or synthetic resin. The frame member 105 includes a guide portion 106 and a positioning projection 107. The guide portion 106 curves with a radius of curvature substantially corresponding to a radius of curvature rc of the inner surface of the transparent tube 81. The positioning projection 107 projects from a flat holding surface 108 that faces a corresponding one of the flat portions 94 of the lens pad 90. The positioning projection 107 has a substantially rectangular sectional shape and is fitted in a corresponding one of the positioning grooves 95 of the lens pad 90. The holding surface 108 of each of the side holding frames 101 and 102 is of a size that matches a corresponding one of the flat portions 94 of the lens pad 90. Therefore, in a state where each of the positioning projections 107 is fitted in a corresponding one of the positioning grooves 95 of the lens pad 90, two ends of the guide portion 106 of the side holding frame 101 or 102 in the direction of the curve of the guide portion 106 do not project from the loci defined as extensions of the curves of the light entering surface 92 and the light emerging surface 93, respectively, of the lens pad 90.

The end holding frames 131 and 132 each include an end lid body 133, a guiding step 134, and a rod 135. The end lid body 133 has a substantially circular sectional shape and is fixedly holds a corresponding one of the two ends of the subassembly including the lens pad 90 and the pair of side holding frames 101 and 102 and having a substantially round columnar shape. The guiding step 134 is provided on the outer side of the end lid body 133 and has a smaller diameter than the end lid body 133. The guiding step 134 is formed as a step projecting from the end lid body 133 by a predetermined length. The rod 135 projects from the outer side of the guiding step 134 and has a noncircular sectional shape (a rectangular sectional shape in the first exemplary embodiment).

The transparent tube 81 is provided at two ends thereof with end caps 140 (141 and 142, specifically, see FIG. 4). The end caps 140 each include an end ring 143 and an annular gear 144. The end ring 143 is fitted in a corresponding one of the two ends of the transparent tube 81. The annular gear 144 is provided on the outer side of and integrally with the end ring 143 and directly or indirectly supplies a rotational driving force to the transparent tube 81. In the first exemplary embodiment, the end caps 140 (141 and 142) do not completely close openings at the two respective ends of the transparent tube 81 and each have a through hole 145 extending through the centers of the end ring 143 and the annular gear 144. A portion of the through hole 145 that extends through the end ring 143 receives the guiding step 134 of a corresponding one of the end holding frames 131 and 132 such that the end ring 143 is slidably rotatable with respect to the guiding step 134 of the end holding frame 131 or 132. A portion of the through hole 145 that extends through the annular gear 144 receives the rod 135 of a corresponding one of the end holding frames 131 and 132 such that the rod 135 projects from the annular gear 144 toward the outside.

Figure 5:
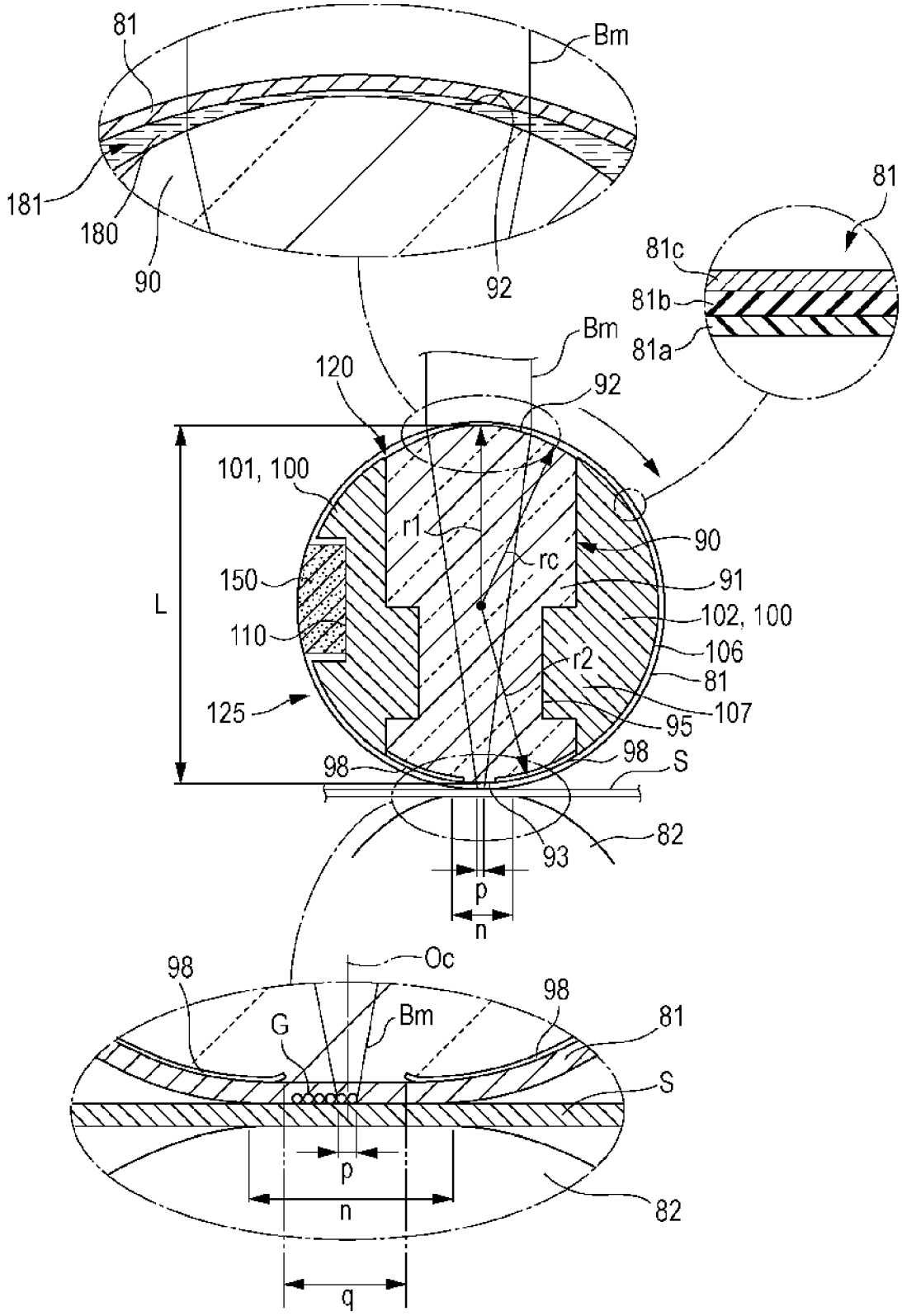
FIG. 5 includes sectional views of the transparent tube and associated elements included in the fixing device according to the first exemplary embodiment and illustrates behaviors of laser light at a light entering position and at a light emerging position of the transparent tube.

FIG. 5 includes sectional views of the transparent tube 81 and associated elements included in the fixing device 80 and illustrates behaviors of the laser light Bm at the light entering position A and at a light emerging position of the transparent tube. As illustrated in FIG. 5, the light entering surface 92 (a first surface) and the light emerging surface 93 (a second surface) have curves defined by radii of curvature r1 and r2 (r1=r2 in the first exemplary embodiment), respectively. The radii of curvature r1 and r2 are smaller than or equal to the radius of curvature rc defining the curve of the inner surface of the transparent tube 81. The radius of curvature r1 defining the curve of the light entering surface 92 of the lens pad 90 and a distance L between the light entering surface 92 and the light emerging surface 93 of the lens pad 90 are determined in advance such that the laser light Bm having been collimated and having entered the lens pad 90 from the light entering position A of the transparent tube 81 is condensed and focus on a focal area p defined around a substantial center Oc of the contact area n between the transparent tube 81 and the counter roller 82. The lens pad 90 is fixedly held by the holding frame 100 in the transparent tube 81. In the first exemplary embodiment, the holding frame 100 is made of a material that does not transmit the laser light Bm (for example, metal such as stainless steel) and holds the lens pad 90.

The lens pad 90 and the counter roller 82 are in contact with each other with the transparent tube 81 interposed therebetween in the contact area n included in the light emerging surface 93. Portions of the light emerging surface 93 are coated with a coating material 98. The coating material 98 (resin, for example) does not transmits the laser light Bm. In the following description, as a matter of convenience, the portions of the light emerging surface 93 that are coated with the coating material 98 are referred to as "coated surfaces."

In the first exemplary embodiment, as illustrated in FIG. 5, the contact area n (plane of contact) between the counter roller 82 and the lens pad 90 includes the light emerging position (the focal area p) and at least a portion of each of the coated surfaces in a section perpendicular to the axis of rotation of the counter roller 82. That is, an area (hereinafter referred to as "lens aperture") q of the light emerging surface 93 excluding the coated surfaces is narrower than the contact area n. Furthermore, in the first exemplary embodiment, the contact area n includes portions of the coated surfaces that are on two respective sides of the lens aperture q in the section perpendicular to the axis of rotation of the counter roller 82 as illustrated in FIG. 5. That is, in the section perpendicular to the axis of rotation of the counter roller 82, the coated surfaces are present at the two respective ends of the contact area n. Particularly, in the first exemplary embodiment, the lens aperture q is present near the center of the contact area n as illustrated in FIG. 5.

1-2-5. Liquid Applying Tool

In the first exemplary embodiment, a liquid applying tool 150 is provided in the transparent tube 81 so as to apply a transparent liquid 180 to the inner surface of the transparent tube 81. The transparent liquid 180 functions as a lubricant that reduces the contact resistance between the transparent tube 81 and the lens pad 90. In the first exemplary embodiment, the liquid applying tool 150 is, for example, a felt member soaked with the transparent liquid 180, such as silicone oil or fluorine oil. The liquid applying tool 150 is provided in the transparent tube 81 as follows, for example. A fitting groove 110 having a substantially rectangular sectional shape and extending in the longitudinal direction of the laser array 84 is provided in a part of the guide portion 106 of the side holding frame 101. The liquid applying tool 150 as a felt member is fixedly fitted in the fitting groove 110 in such a manner as to be closely in contact with the inner surface of the transparent tube 81. Thus, the transparent liquid 180 with which the liquid applying tool 150 is soaked is evenly applied to the inner surface of the transparent tube 81.

1-2-6. Inserting Lens Pad Subassembly with Liquid Applying Tool into Transparent Tube A process of inserting the lens pad 90 into the transparent tube 81 will now be described. First, to assemble the lens pad 90 and the holding frame 100, referring to FIG. 3, the pair of side holding frames 101 and 102 are fitted to the lens pad 90 from the two respective sides, and the pair of end holding frames 131 and 132 are attached to the two respective ends of the subassembly including the lens pad 90 and the side holding frames 101 and 102, whereby a lens pad subassembly 120 (see FIG. 4) including the lens pad 90 and the holding frame 100 is obtained.

Referring now to FIG. 4, one of the end caps 140 (the end cap 141 in this case) is fitted into the opening at one of the two ends of the transparent tube 81. Then, the lens pad subassembly 120 is inserted into the transparent tube 81 from the opening at the other end of the transparent tube 81. The guiding step 134 of the end holding frame 131 included in the lens pad subassembly 120 is fitted into the end ring 143 of the one end cap 140 (the end cap 141 in this case) having been fitted to the transparent tube 81. In this step, the rod 135 of the end holding frame 131 projects from the through hole 145 of the annular gear 144 of the end cap 140 (the end cap 141 in this case). With the lens pad subassembly 120 that includes the lens pad 90 being in the transparent tube 81, the other end cap 140 (the end cap 142 in this case) is fitted into the opening at the other end of the transparent tube 81 such that the guiding step 134 of the other end holding frame 132 of the lens pad subassembly 120 is fitted into the end ring 143 of the other end cap 140 (the end cap 142 in this case) and the rod 135 of the end holding frame 132 projects from the through hole 145 of the annular gear 144 included in the end cap 140 (the end cap 142 in this case).

In the first exemplary embodiment, before the step of inserting the lens pad subassembly 120 into the transparent tube 81, the liquid applying tool 150 soaked with the transparent liquid 180 is fitted into the lens pad subassembly 120 in advance. In this state, the lens pad subassembly 120 provided with the liquid applying tool 150 is inserted into the transparent tube 81. Thus, the insertion of the lens pad subassembly 120 provided with the liquid applying tool 150 into the transparent tube 81 is complete, and a transparent tube assembly 125 including the lens pad subassembly 120 and the liquid applying tool 150 is obtained.

1-2-7. Driving System Provided for Fixing Device

Figure 6:
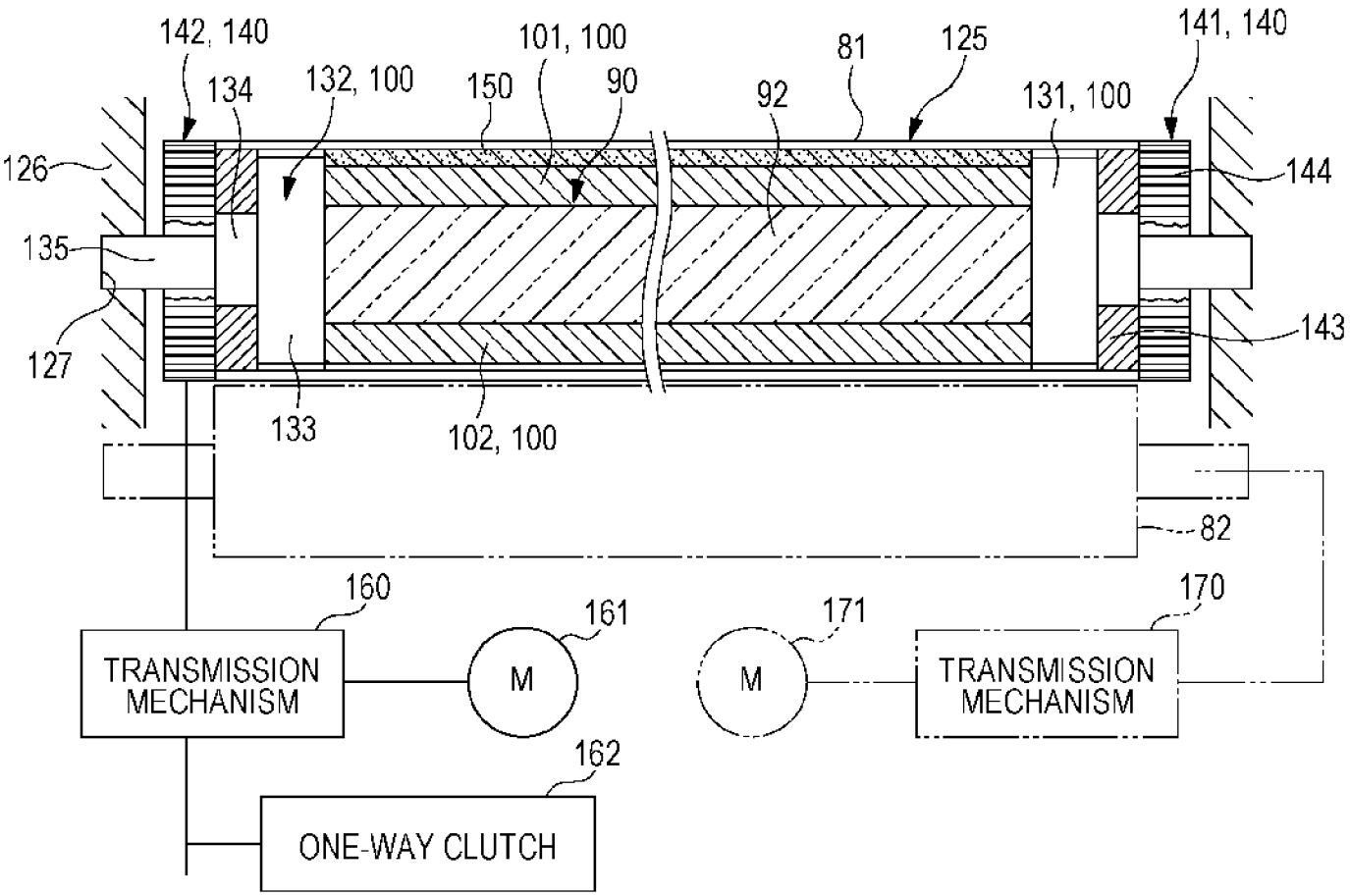
FIG. 6 illustrates an exemplary driving system provided for the fixing device according to the first exemplary embodiment.

FIG. 6 illustrates an exemplary driving system provided for the fixing device 80. After the transparent tube assembly 125 is obtained, the transparent tube assembly 125 is attached to a predetermined portion of the apparatus housing 60 as illustrated in FIG. 6. In this step, the transparent tube assembly 125 is fixed to the apparatus housing 60 by fixedly inserting the rods 135 projecting from the two respective ends of the lens pad subassembly 120 into respective supporting holes 127 provided in a fixing device housing 126. In a driving system provided for the transparent tube 81 included in the transparent tube assembly 125, a driving motor 161 is connected to the annular gear 144 of one of the end caps 140 (the end cap 142, for example, in this case) via a transmission mechanism 160. Thus, a driving force generated by the driving motor 161 is transmitted to the transparent tube 81 via the end cap 140 (the end cap 142 in this case). In the first exemplary embodiment, the other end cap 140 provided to the transparent tube 81 also includes the annular gear 144. The annular gears 144 are rotatably supported by respective supporting gears (not illustrated), whereby the loads applied to the two respective axial ends of the transparent tube 81 are balanced with each other.

In the first exemplary embodiment, the counter roller 82 is provided with another driving system that is separate from the driving system provided for the transparent tube 81. In the driving system for the counter roller 82, the counter roller 82 is connected to a driving motor 171 via a transmission mechanism 170 including elements such as gears and belts, whereby a driving force generated by the driving motor 171 is transmitted to the counter roller 82 via the transmission mechanism 170.

In the first exemplary embodiment, since the separate driving systems are provided for the transparent tube 81 and the counter roller 82, respectively, there may be a great speed difference between the transparent tube 81 and the counter roller 82 in the contact area n. Therefore, in the first exemplary embodiment, the driving system for the transparent tube 81 includes, for example, a one-way clutch 162 added to the transmission mechanism 160. Thus, if there is a great speed difference between the transparent tube 81 and the counter roller 82 in the contact area n, the one-way clutch 162 is activated, whereby the speed difference between the two in the contact area n is reduced. Although the first exemplary embodiment concerns a case where the transparent tube 81 and the counter roller 82 are provided with separate driving systems, the present invention is not limited to such a case. For example, only the counter roller 82 may be provided with a driving system, and the transparent tube 81 may be made to follow the rotation of the counter roller 82 in the contact area n where the transparent tube 81 is in contact with the counter roller 82.

1-3. Operation

To perform an image forming operation in the image forming apparatus, an image-forming-mode-selecting button (not illustrated) is operated, and a start switch (not illustrated) is then turned on. In this step, as illustrated in FIG. 1, the image forming units 20 (20*a* to 20*d*) form images with toners in the respective color components on the respective photoconductors 21, and the images are sequentially transferred to the intermediate transfer body 30 for the first transfer. When the images thus transferred to the intermediate transfer body 30 reach the collective transfer area (a second transfer area), the images are collectively transferred to a recording medium S by the collective transfer device 50. Subsequently, the images yet to be fixed on the recording medium S are fixed to the recording medium S by the fixing device 80.

In the fixing device 80, as illustrated in FIGS. 2 and 5, the laser light Bm emitted from the laser array 84 of the laser-light-emitting device 83 is collimated by the collimator lens 86 and falls onto the light entering position A of the transparent tube 81. The laser light Bm fallen onto the light entering position A of the transparent tube 81 is transmitted through the transparent tube 81, enters the lens pad 90 from the light entering surface 92, travels through the lens body 91, emerges from the light emerging surface 93, is transmitted through the transparent tube 81 again, and is condensed toward the toner image G on the recording medium S. In this step, the toner image G is fixed to the recording medium S by the laser light Bm.

In the above fixing process, the fixing device 80 according to the first exemplary embodiment operates as follows.

(1) Rotation of Transparent Tube

The transparent tube 81 receives the driving force of the driving motor 161 via the transmission mechanism 160 and the end cap 142 (140) and rotates together with the counter roller 82. Thus, the recording medium S is nipped in the contact area n between the transparent tube 81 and the counter roller 82 and is transported. In this step, the transparent tube 81 rotates while being guided along the circumference of the lens pad subassembly 120 having a round columnar shape. Specifically, the transparent tube 81 rotates while being in contact with the light entering surface 92 and the light emerging surface 93 of the lens pad 90 and with the guide portions 106 of the side holding frames 101 and 102.

(2) Pressure Application and Light Condensation by Lens Pad

The lens pad 90 is fixed at a predetermined position by the holding frame 100. The lens pad 90 has the light entering surface 92 that is curved with the predetermined radius of curvature r1. The distance L between the light entering surface 92 and the light emerging surface 93 is predetermined. Therefore, the laser light Bm fallen onto the light entering position A of the transparent tube 81 travels through the lens pad 90 having a predetermined depth of focus and is condensed on the basis of predetermined condensation characteristics. The light emerging surface 93 of the lens pad 90 that is fixed at the predetermined position presses the transparent tube 81 against the counter roller 82 with a predetermined pressure. Hence, in the contact area n between the transparent tube 81 and the counter roller 82, the toner image G on the recording medium S is heated under the pressure applied thereto in the focal area p of the laser light Bm.

(3) Application of Transparent Liquid

In the first exemplary embodiment, the liquid applying tool 150 soaked with the transparent liquid 180 such as silicone oil is provided in contact with the inner surface of the transparent tube 81. Therefore, the transparent liquid 180 is applied to the inner surface of the transparent tube 81. In this state, the transparent tube 81 and the light entering surface 92 of the lens pad 90 are in contact with each other at the light entering position A of the transparent tube 81 with an interfacial air layer 181 interposed between the transparent tube 81 and the light entering surface 92 because of the difference in radius of curvature and so forth. However, in the first exemplary embodiment, the interfacial air layer 181 between the transparent tube 81 and the light entering surface 92 is filled with the transparent liquid 180. Therefore, the laser light Bm fallen onto the light entering position A of the transparent tube 81 is transmitted through the transparent liquid 180 and reaches the light entering surface 92 of the lens pad 90. If there is no transparent liquid 180 in the interfacial air layer 181, some portions of the laser light Bm are reflected by the interfacial air layer 181. However, the presence of the transparent liquid 180 in the interfacial air layer 181 suppresses such reflection of the laser light Bm. Correspondingly, the loss of the laser light Bm applied is reduced. Furthermore, even if the transparent tube 81 comes into contact with the circumferential surface of the lens pad subassembly 120, the transparent liquid 180 applied to the inner surface of the transparent tube 81 functions as a lubricant and reduces the contact resistance between the two.

In the first exemplary embodiment, the liquid applying tool 150 is positioned on the upstream side with respect to the light entering position A and on the downstream side with respect to the contact area n in the direction of rotation of the transparent tube 81. That is, the interfacial air layer 181 facing the light entering surface 92 of the lens pad 90 is provided near the position of application of the transparent liquid 180 by the liquid applying tool 150 and is therefore fully filled with the transparent liquid 180. There is another interfacial air layer 181 in a portion facing the light emerging surface 93 of the lens pad 90. This interfacial air layer 181 is provided far from the position of application of the transparent liquid 180 by the liquid applying tool 150 and is filled with a moderate amount of transparent liquid 180. Therefore, the laser light Bm is effectively prevented from being reflected by the interfacial air layer 181 and being wasted.

In the first exemplary embodiment, the light emerging surface 93 of the lens pad 90 presses the transparent tube 81 against the counter roller 82. Hence, the interfacial air layer 181 is more likely to be provided between the transparent tube 81 and the light entering surface 92 of the lens pad 90. Therefore, the position of the liquid applying tool 150 is determined as described above.

(4) Determining Focal Area of Laser Light

Figure 7A:
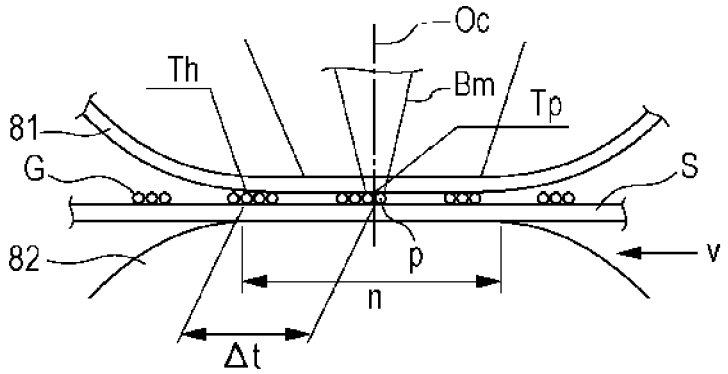
FIG. 7A schematically illustrates a fixing process performed in a contact area of the fixing device according to the first exemplary embodiment.
Figure 7B:
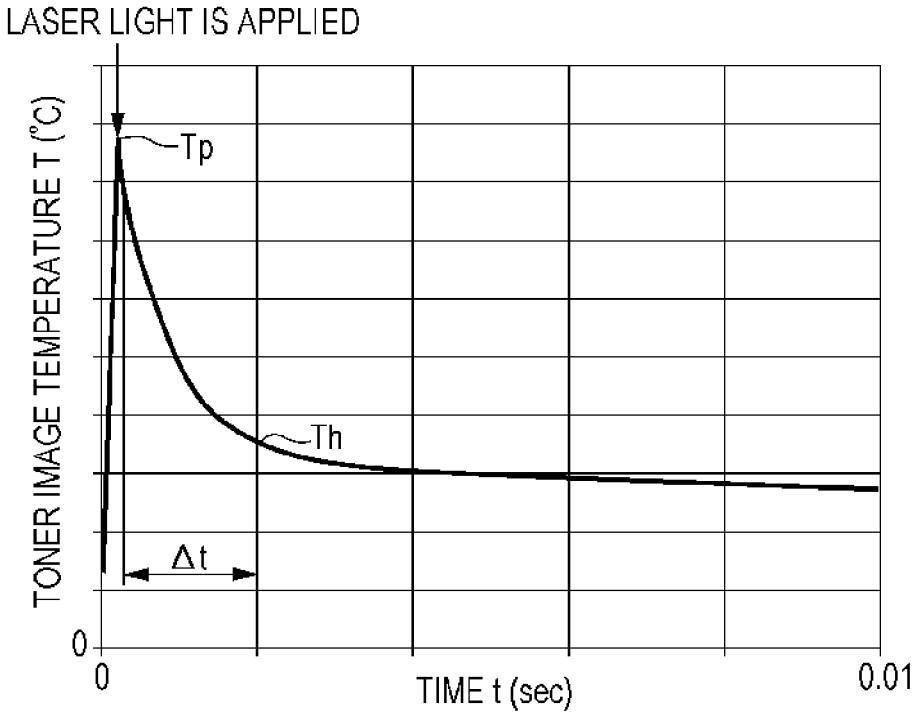
FIG. 7B is a graph illustrating an exemplary temperature change in a toner image after the application of laser light that is observed during the fixing process performed by the fixing device according to the first exemplary embodiment.

FIG. 7A schematically illustrates the fixing process performed in the contact area n of the fixing device 80. FIG. 7B is a graph illustrating an exemplary temperature change in the toner image G after the application of the laser light Bm that is observed during the fixing process performed by the fixing device 80. In the first exemplary embodiment, as illustrated in FIG. 7A, the focal area p of the laser light Bm is defined around the substantial center Oc of the contact area n between the transparent tube 81 and the counter roller 82.

The temperature change graphed in FIG. 7B is obtained in a case where the toner image G is not released from the transparent tube 81 after the application of the laser light Bm of, for example, 0.2 ms·0.81 J/cm$^2$. According to the graph in FIG. 7B, the temperature of the toner image G reaches a peak temperature Tp (200° C., for example) immediately after the laser light application, drops to about Tp/2 (100° C., for example) in 1 ms, and to about Tp/3 (70° C., for example) in 2 ms. Hence, it is understood that, if the toner image G stays in the contact area n between the transparent tube 81 and the counter roller 82 for a short period of time of 1 to 2 ms after the laser light application, the temperature of the toner image G drops to a cooled temperature Th (70° C. to 100° C., for example) at which the toner image G is releasable from the transparent tube 81.

Referring to the graph illustrated in FIG. 7B, letting the period of time in which the peak temperature Tp marked immediately after the laser light application drops to the cooled temperature Th at which the toner image G is releasable be Δt, a transport speed v at which the recording medium S is transported only needs to be determined such that, in the contact area n between the transparent tube 81 and the counter roller 82, the period of time t in which a portion of the recording medium S that is positioned in the focal area p of the laser light Bm moves to the downstream end of the contact area n in the direction of transport of the recording medium S is Δt or longer as illustrated in FIG. 7A.

In a fixing device that fixes toner to a recording medium by applying laser light to the toner, if the lens aperture is wider than the contact area, the laser light may leak from an area where the surface of the lens pad is not in contact with the counter roller. If the laser light leaks from the lens pad, other components of the image forming apparatus may be, for example, deformed. Consequently, components of the image forming apparatus or maintenance workers who perform maintenance work of the image forming apparatus may be adversely affected. In contrast, in the first exemplary embodiment, as illustrated in FIG. 5, the lens aperture q of the lens pad 90 is narrower than the contact area n between the counter roller 82 and the transparent tube 81, and the portions of inner surface of the transparent tube 81 in the contact area n excluding the lens aperture q are covered with the coating material 98 that does not transmit the laser light Bm. Therefore, the leakage of the laser light Bm from the area where the lens pad 90 is not in contact with the counter roller 82 is suppressed.

In addition, reducing the width of the lens pad 90 and surrounding the lens pad 90 with another member may also suppress the leakage of the laser light Bm. In that case, however, the difference in the coefficient of thermal expansion between the lens pad 90 and that member or other possible factors may produce a level difference between the surface of the lens pad 90 and the surface of that member in the contact area n between the counter roller 82 and the transparent tube 81. To avoid such a situation, in the first exemplary embodiment, the surface of the lens pad 90 is covered with the coating material 98. Therefore, the level difference in the contact area n is smaller than in the case where the lens pad 90 is surrounded by another member.

In the first exemplary embodiment, the contact area n includes portions of the coated surfaces at the two respective ends thereof in the section perpendicular to the axis of rotation of the counter roller 82. Therefore, the leakage of the laser light Bm from the two ends of the light emerging position is suppressed.

2. Second Exemplary Embodiment

Figure 8:
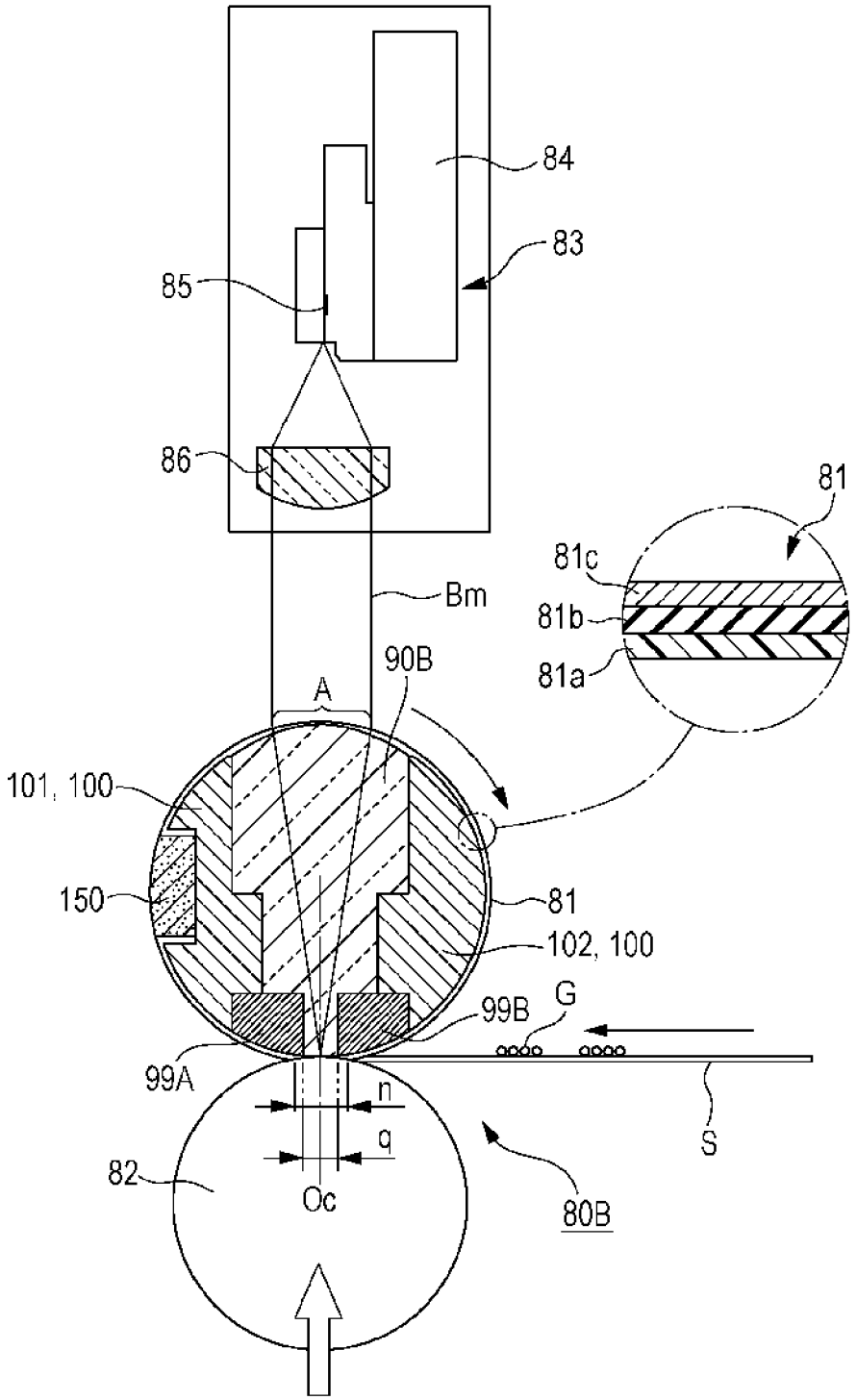
FIG. 8 illustrates an overall configuration of a fixing device according to a second exemplary embodiment.

FIG. 8 illustrates elements included in a fixing device 80B according to a second exemplary embodiment. The fixing device 80B illustrated in FIG. 8 differs from the fixing device 80 according to the first exemplary embodiment in including a lens pad 90B instead of the lens pad 90. Other elements that are the same as those described in the first exemplary embodiment are denoted by corresponding ones of the reference numerals used in the first exemplary embodiment, and detailed description thereof is omitted herein.

The lens pad 90B includes light blocking layers 99A and 99B made of a material that does not transmit the laser light Bm (for example, any of various kinds of colored glass for optical use, colored plastic resin for optical use, or the like). The material of the light blocking layers 99A and 99B is selected from those intended for normal lenses, having heat resistance, and not transmitting the laser light Bm or having a lower transmittance with respect to the laser light Bm than a predetermined threshold. The lens pad 90B may be formed by integral molding or may be formed by assembling a lens pad body and the light blocking layers 99A and 99B together and then polishing the light emerging surface 93.

As in the first exemplary embodiment, in the second exemplary embodiment, a portion (lens aperture q) of the light emerging surface 93 of the lens pad 90 excluding the surfaces of the light blocking layers 99A and 99B is narrower than the contact area n between the counter roller 82 and the transparent tube 81. Furthermore, portions in the contact area n excluding the lens aperture q are covered with the light blocking layers 99A and 99B made of a material that does not transmit the laser light Bm. Hence, the leakage of the laser light Bm from an area in which the lens pad 90B is not in contact with the counter roller 82 is suppressed.

In the second exemplary embodiment, the light blocking layers 99A and 99B are made of a material intended for lenses. Hence, the difference in the coefficient of thermal expansion between the lens body and the light blocking layers 99A and 99B is not so great. Accordingly, in the second exemplary embodiment, the level difference in the contact area n is smaller than in a case where the laser light is blocked by any members made of any other materials.

3. Modifications

While some exemplary embodiments of the present invention have been described above, the present invention is not limited to the above exemplary embodiments and may be modified in various ways. Exemplary modifications will be described below. Note that the following modifications may be combined in any way.

3-1. Modification 1

The first exemplary embodiment concerns a case where portions of the light emerging surface 93 of the lens pad 90 are covered with the coating material 98. The second exemplary embodiment concerns a case where the lens pad 90B includes the light blocking layers 99A and 99B around the focal area p. The configuration of the condensing member according to the present invention is not limited to those described above. The condensing member only needs to have a light emerging surface (the second surface) a portion of which is made of a material not transmitting the laser light and, in the section perpendicular to the axis of rotation of the counter roller 82, the contact area n between the counter roller 82 and the condensing member only needs to include at least a part of the portion that is made of the material not transmitting the laser light.

Figure 9:
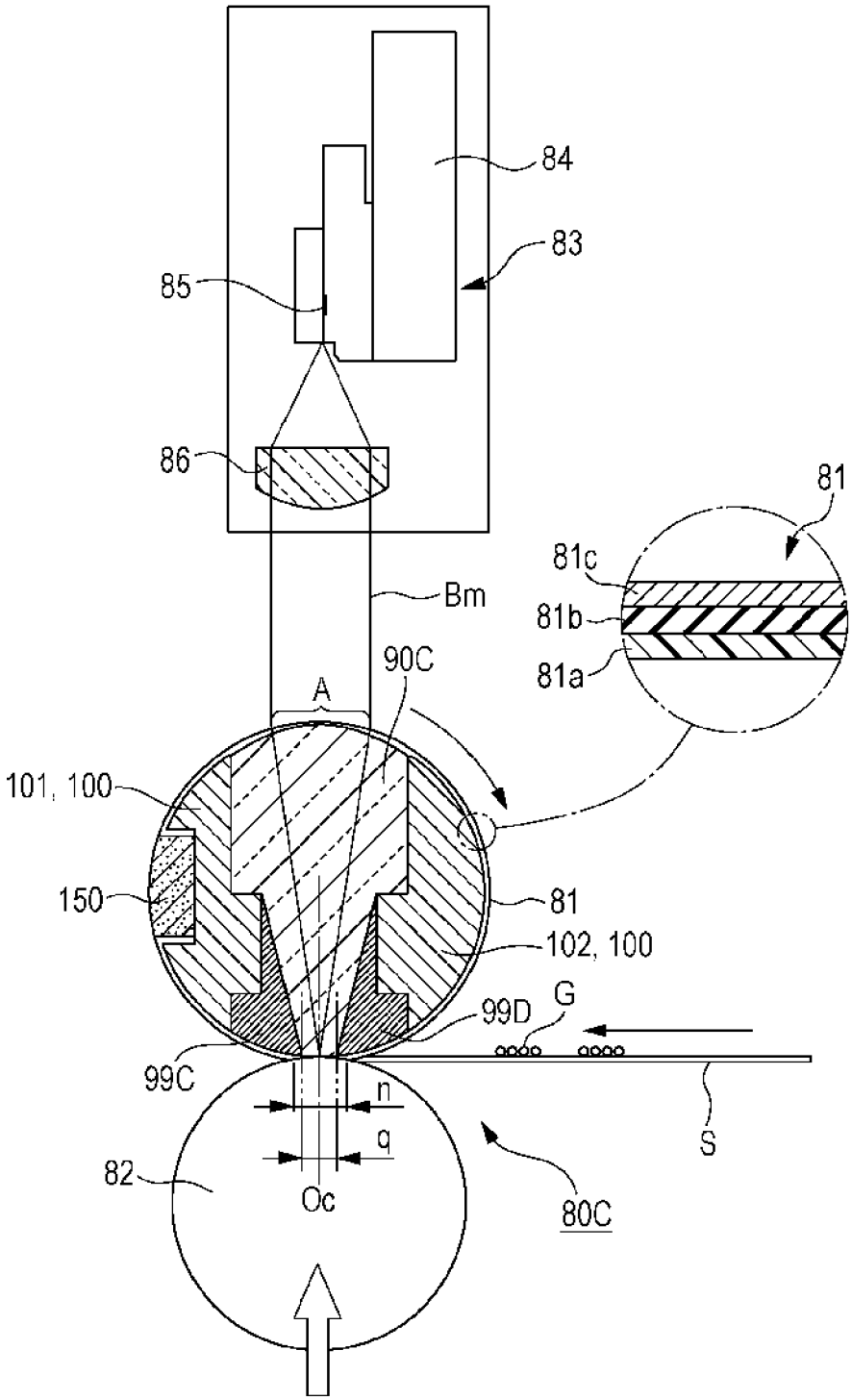
FIG. 9 illustrates an overall configuration of a fixing device according to a modification.

FIG. 9 illustrates an overall configuration of a fixing device 80C according to Modification 1. In Modification 1 illustrated in FIG. 9, a lens pad 90C includes light blocking layers 99C and 99D that are made of a material not transmitting the laser light Bm. The material of the light blocking layers 99C and 99D is selected from those intended for normal lenses, having heat resistance, and not transmitting the laser light Bm (or having a lower transmittance with respect to the laser light Bm than a predetermined threshold). The light blocking layers 99C and 99D differ from the light blocking layers 99A and 99B in the shape of the section perpendicular to the axis of rotation of the counter roller 82.

In Modification 1 also, the portion (lens aperture q) of the light emerging surface 93 of the lens pad 90C excluding the surfaces of the light blocking layers 99C and 99D is narrower than the contact area n between the counter roller 82 and the transparent tube 81. Furthermore, portions in the contact area n excluding the lens aperture q are covered with the light blocking layers 99C and 99D made of a material that does not transmit the laser light Bm. Hence, the leakage of the laser light Bm from an area in which the lens pad 90C is not in contact with the counter roller 82 is suppressed. The shape of the light blocking layers provided to the lens pad is not limited to those illustrated in FIGS. 8 and 9 and may be any of various other shapes. Likewise, the positions of the coated surfaces are not limited to those described in the first exemplary embodiment.

3-2. Modification 2

In the first exemplary embodiment, the contact area n may include not only the light emerging position (focal area p) but also at least portions of the coated surfaces in a section parallel to the axis of rotation of the counter roller 82. If the lens aperture q of the lens pad 90 through which the laser light Bm travels is narrower than the contact area n not only in the direction perpendicular to the axis of rotation of the counter roller 82 but also in the direction parallel to the axis of rotation of the counter roller 82, the leakage of the laser light Bm to peripheral areas is suppressed.

In the second exemplary embodiment also, the contact area n may include not only the light emerging position (focal area p) but also at least portions of the surfaces of the light blocking layers 99A and 99B in the section parallel to the axis of rotation of the counter roller 82. If the lens aperture q of the lens pad 90B through which the laser light Bm travel is narrower than the contact area n not only in the direction perpendicular to the axis of rotation of the counter roller 82 but also in the direction parallel to the axis of rotation of the counter roller 82, the leakage of the laser light Bm to peripheral areas is suppressed.

3-3. Modification 3

The first exemplary embodiment concerns a case where the contact area n includes the portions of the coated surfaces that are on the two respective sides of the light emerging position (focal area p) in the section perpendicular to the axis of rotation of the counter roller 82. The contact area n is not limited to that described above. The contact area n may include only a portion of the coated surface that is on one side of the light emerging position (focal area p). In such a modification also, the leakage of the laser light Bm is smaller than in a case where the contact area n includes no portions of the coated surfaces.

The second exemplary embodiment concerns a case where the contact area n includes the surfaces of the light blocking layers 99A and 99B that are on the two respective sides of the light emerging position (focal area p) in the section perpendicular to the axis of rotation of the counter roller 82. The contact area n is not limited to that described above. The contact area n may include only the surface of one of the light blocking layers 99A and 99B that is on one side of the light emerging position (focal area p). In such a modification also, the leakage of the laser light Bm is smaller than in the case where the contact area n includes no surfaces of the light blocking layers 99A and 99B.

3-4. Modification 4

The first and second exemplary embodiments each concern a case where the lens pad subassembly 120 includes the lens pad 90 or 90B held by the holding frame 100 including the side holding frames 101 and 102 and the end holding frames 131 and 132. The lens pad subassembly 120 is not limited to have such a configuration.

Figure 10A:
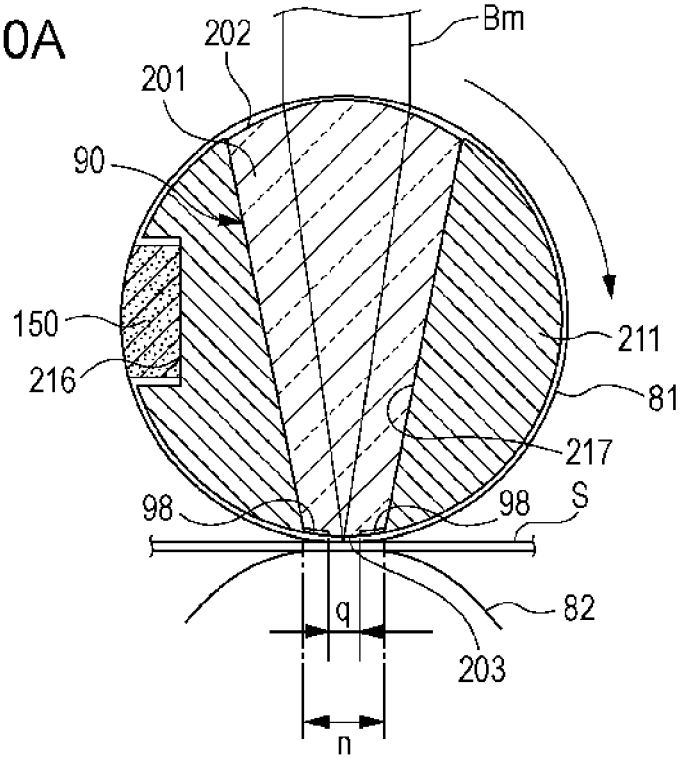
FIG. 10A illustrates a lens pad subassembly according to another modification.
Figure 10B:
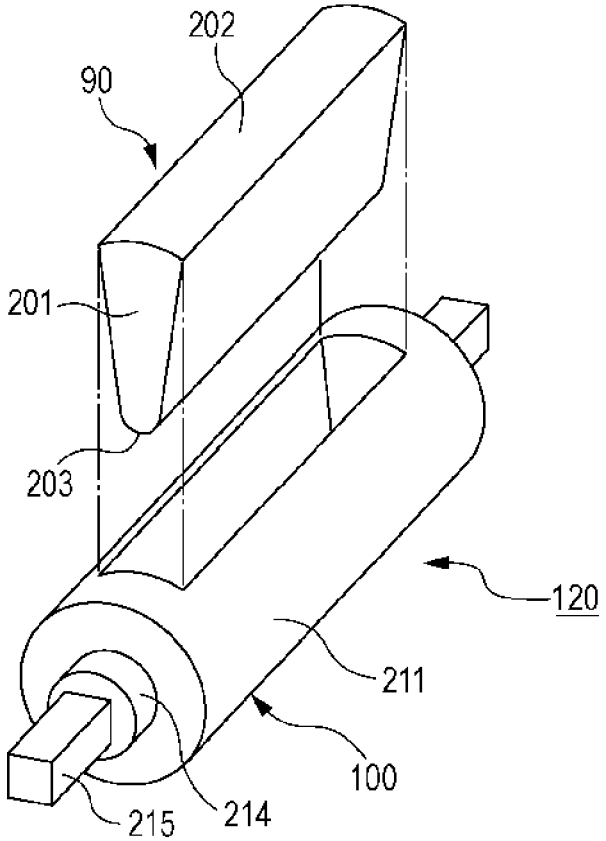
FIG. 10B is a partially exploded perspective view of the lens pad subassembly.

FIG. 10A illustrates a modification of the lens pad subassembly 120. FIG. 10B is a partially exploded perspective view illustrating associated elements included in the lens pad subassembly 120. In the modification illustrated in FIGS. 10A and 10B, the lens pad 90 includes a lens body 201 having a substantially wedge-like sectional shape. The lens body 201 includes a light entering portion 202 on a wide side thereof, and a light emerging portion 203 on a narrow side thereof. The holding frame 100 includes a columnar portion 211, with guiding steps 214 and rods 215 integrally provided at two respective ends of the columnar portion 211. The columnar portion 211 has an fitting groove 216 in which the liquid applying tool 150 is fitted, and a positioning hole 217 having a shape corresponding to the shape of the lens pad 90 and extending through the columnar portion 211.

In Modification 4, the lens pad subassembly 120 is obtained by inserting the lens pad 90 into the positioning hole 217 of the holding frame 100 such that the light entering portion 202 and the light emerging portion 203 of the lens pad 90 are exposed continuously with the circumferential surface of the holding frame 100, whereby the lens pad 90 is positioned in the holding frame 100. Modification 4 concerns a case where the holding frame 100 includes the columnar portion 211, the guiding steps 214, and the rods 215 that are integrally molded. Alternatively, for example, a holding frame body including the columnar portion 211 may be prepared separately from side holding frames including the respective guiding steps 214 and the respective rods 215, and the holding frame body and the side holding frames may be then bonded to each other with adhesive or the like, whereby the lens pad subassembly 120 may be obtained.

In Modification 4 illustrated in FIGS. 10A and 10B, as in the first exemplary embodiment, the lens aperture q of the lens pad 90 is narrower than the contact area n. Furthermore, portions of the lens pad 90 in the contact area n excluding the lens aperture q are covered with the coating material 98 that does not transmit the laser light Bm. Hence, the leakage of the laser light Bm from the contact area n is suppressed.

3-5. Modification 5

While the above exemplary embodiments each concern an image forming apparatus that forms an image by an electrophotographic method, the image forming apparatus is not limited to that described above. For example, the image forming apparatus may employ an electrostatic recording method in which an image is formed by utilizing ionic currents.

3-6. Modification 6

While the above exemplary embodiments each concern the transparent tube 81 as an exemplary tube body. The tube body is not limited to that described above and may be a rigid or elastic body as long as it is made of a transparent material and has a tubular shape. Although there is no problem with a tube body having a monolayer structure, a tube body including plural functional layers may be employed, considering the provision of satisfactory strength, satisfactory area of contact with the counter roller 82, releasability from the toner image G, and so forth.

In each of the above exemplary embodiments, the fixing device 80 may have a configuration not including the transparent tube 81 (the tube body). In that case, for example, the recording medium S may be transported by the counter roller 82 while sliding along the surface of the lens pad 90.

3-7. Modification 7

The above exemplary embodiments each concern the counter roller 82 as an exemplary roller. The roller is not limited to the counter roller 82 described above and only needs to be a member that provides a satisfactory contact area in combination with the tube body and to nip and transport the recording medium S in cooperation with the tube body. Considering the effective utilization of the laser light Bm that has been transmitted through the recording medium S, the roller may have a reflecting surface that reflects the laser light Bm.

3-8. Modification 8

The above exemplary embodiments each concern the laser-light-emitting device 83 as an exemplary light source. The light source is not limited to the laser-light-emitting device 83 described above and only needs to be a device that emits laser light toward a predetermined light entering position of the tube body.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a light source that emits laser light;

a condensing member including a lens having a first surface from which the laser light enters and a second surface from which the laser light emerges, the lens condensing the laser light that has entered from the first surface and emitting the laser light from the second surface; and a roller provided in contact with the condensing member and that transports a recording medium advanced into a position between the roller and the condensing member, wherein a portion of the second surface is made of a material that blocks the laser light, and wherein, in a section perpendicular to an axis of rotation of the roller, a plane of contact between the roller and the condensing member includes at least a part of the portion made of the material that blocks the laser light.

2. The fixing device according to claim 1, wherein the material is a coating material that covers a portion of a surface of the condensing member, and wherein, in the section perpendicular to the axis of rotation of the roller, the plane of contact between the roller and the condensing member includes at least a part of the portion of the surface covered with the coating material.

3. The fixing device according to claim 1, wherein the lens includes a light blocking layer made of the material, and wherein, in the section perpendicular to the axis of rotation of the roller, the plane of contact between the roller and the condensing member includes at least a part of a surface of the light blocking layer.

4. The fixing device according to claim 1, wherein the condensing member includes a tube body made of a material that transmits the laser light and in which the lens is housed such that the tube body is rotatable with respect to the lens, and wherein the tube body transports the recording medium by rotating with the rotation of the roller.

5. The fixing device according to claim 1, wherein, in the section perpendicular to the axis of rotation of the roller, surfaces made of the material are present at two respective ends of the plane of contact.

6. The fixing device according to claim 5, wherein, in a section parallel to the axis of rotation of the roller, the plane of contact includes at least a part of the surfaces made of the material.

7. An image forming apparatus comprising:

an image forming device that forms a toner image on a recording medium; and the fixing device according to claim 1 that fixes the toner image to the recording medium.

* * * * *